US005888718A

United States Patent [19]

Maskasky et al.

[11] Patent Number: 5,888,718

[45] Date of Patent: Mar. 30, 1999

[54] MODIFIED PEPTIZER FOR PREPARING HIGH CHLORIDE (100) TABULAR GRAIN EMULSIONS

[75] Inventors: Joe E. Maskasky; Victor P. Scaccia, both of Rochester, N.Y.

[73] Assignee: Eastman Kodak Company, Rochester, N.Y.

[21] Appl. No.: 978,528

[22] Filed: Nov. 25, 1997

[51] Int. Cl.[6] ..... G03C 1/047; G03C 1/035

[52] U.S. Cl. ..... 430/569; 430/567; 430/642

[58] Field of Search ..... 430/567, 569, 430/642

[56] References Cited

U.S. PATENT DOCUMENTS

| | | | |
|---|---|---|---|
| 4,945,037 | 7/1990 | Saitou | 430/567 |
| 5,087,555 | 2/1992 | Saitou | 430/567 |
| 5,264,337 | 11/1993 | Maskasky | 430/567 |
| 5,292,632 | 3/1994 | Maskasky | 430/567 |
| 5,320,938 | 6/1994 | House et al. | 430/567 |
| 5,413,904 | 5/1995 | Chang et al. | 430/569 |
| 5,641,620 | 6/1997 | Yamashita et al. | 430/569 |
| 5,663,041 | 9/1997 | Chang et al. | 430/569 |
| 5,665,530 | 9/1997 | Oyamada et al. | 430/567 |

FOREIGN PATENT DOCUMENTS

| | | | |
|---|---|---|---|
| 0 645 670 A1 | 3/1995 | European Pat. Off. | G03C 1/035 |
| 0 670 515 A2 | 9/1995 | European Pat. Off. | G03C 1/015 |
| 95/287334 | 10/1995 | Japan | G03C 1/047 |

OTHER PUBLICATIONS

*Research Disclosure,* vol. 389, Sep. 1996, Item 38957, II.

Mees, *The Theory of the Photographic Process,* Rev. Ed., Chapter 3, The Preparation and Properties of Gelatin, pp. 48–98.

Band, *Photographic Gelatin,* Royal Photographic Society, London (1987) pp. 17–22, R.E. Norland, titled "Fish Gelatin, Technical Aspects and Applications".

*Primary Examiner*—Mark F. Huff

*Attorney, Agent, or Firm*—Carl O. Thomas

[57] ABSTRACT

A process is disclosed of precipitating high chloride {100 } tabular grain emulsions having an average tabular grain thickness of less than 0.3 micrometer. Higher average grain equivalent circular diameters and aspect ratios are realized by employing a gelatino-peptizer during at least a portion of the precipitation that satisfies the formula:

$$(Pro+Hypro)\div(Ser+Thr)=<4.0$$

wherein Pro, Hypro, Ser and Thr represent the proline, hydroxyproline, serine, and threonine amino acid components, respectively, of the gelatino-peptizer. When the formula satisfying gelatino-peptizer is present during grain nucleation and contains at least 40 micromoles of methionine per gram of gelatino-peptizer, the high chloride {100} tabular grains account for a high proportion of total grain projected area. When the formula satisfying gelatino-peptizer is present during grain growth and contains <4 micromoles of methionine per gram of gelatino-peptizer, the time required to prepare the emulsion is reduced.

12 Claims, No Drawings

MODIFIED PEPTIZER FOR PREPARING HIGH CHLORIDE (100) TABULAR GRAIN EMULSIONS

FIELD OF THE INVENTION

The invention is directed to a process of preparing photographically useful silver halide emulsions. Specifically, the invention relates to an improved process for preparing high chloride {100} tabular grain emulsions.

DEFINITIONS

In referring to grains and emulsions containing two or more halides, the halides are named in order of ascending concentrations.

The term "high chloride" in referring to grains and emulsions indicates that chloride is present in a concentration of greater than 50 mole percent, based on total silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and an aspect ratio of at least 2.

The term "tabular grain emulsion" refers to an emulsion in which tabular grains account for greater than 50 percent of total grain projected area.

The term "{100} tabular" is employed in referring to tabular grains and tabular grain emulsions containing tabular grains having {100} major faces.

The term "vAg" indicates the potential difference in volts measured during precipitation starting with a standard reference electrode (Ag/AgCl with 4 molar KCl at room temperature) in a 4 molar KCl salt bridge and a AgCl coated Ag billet indicator electrode.

The term "gelatino-peptizer" is employed in its art recognized sense to designate gelatin (e.g., animal collagen), or a gelatin derivative (e.g., acetylated or phthalated gelatin).

*Research Disclosure* is published by Kenneth Mason Publications, Ltd., Dudley House, 12 North St., Emsworth, Hampshire P010 7DQ, England.

BACKGROUND

There are many reasons for believing high chloride {100} tabular grain emulsions, the invention of Maskasky U.S. Pat. Nos. 5,264,337 and 5,292,632, to be ideal for a variety of photographic applications. Tabular grain emulsions are well known to offer improved sharpness and an improved speed-granularity relationship. Silver chloride emulsions are recognized to be ecologically attractive and to possess the capability of rapid processing. Silver chloride grains with predominantly {100} crystal faces are recognized to have a high degree of shape stability, allowing morphologically stable {100} tabular grains to be formed.

Recently interest in precipitating high chloride {100} tabular grain emulsions has been directed to processes that can be analyzed as containing a step that creates grain nuclei containing crystal lattice dislocations that promote the growth of high chloride {100} tabular grains and a subsequent step in which the grain nuclei are grown into {100} tabular grains. The following patents are representative:

House et al U.S. Pat. No. 5,320,938; Chang et al U.S. Pat. Nos. 5,413,904 and 5,663,041; Yamashita et al U.S. Pat. No. 5,641,620; and Oyamada et al U.S. Pat. No. 5,665,530.

All of the above patents employ a gelatino-peptizer. It is generally understood that gelatin used to form the gelatino-peptizer is derived from the collagen of warm blooded animals. The majority of gelatin employed in preparing silver halide grain containing photographic elements is derived from the bones and, to a lesser extent, the hides of cattle. Acid-treated gelatin, such as pig-skin gelatin, is also employed. These common origins of photographic gelatin are acknowledged in *Research Disclosure*, Vol 389, September 1996, Item 38957, II. Vehicles, vehicle extenders, vehicle-like addenda and vehicle related addenda, A. Gelatin and hydrophilic colloid peptizers, paragraph (1) and explained in detail in Mees, *The Theory of the Photographic Process*, Revised Ed., Macmillan, N.Y., Chapter 3, The Preparation and Properties of Gelatin, pp. 48–98.

It has been recognized that gelatin derived from fish skin can be employed as a peptizer in the preparation of the silver halide emulsions, as illustrated by Mori et al Kokai 95/287334, published Oct. 31, 1995, filed Apr. 15, 1994. Band, *Photographic Gelatin*, Royal Photographic Society, London (1987), pp. 17–22, contains a section by R. E. Norland, titled, "Fish Gelatin, Technical Aspects and Applications".

SUMMARY OF THE INVENTION

In one aspect this invention is directed to a process of precipitating a photographically useful emulsion containing silver halide grains comprised of at least 50 mole percent chloride, based on silver, with tabular grains having {100} major faces accounting for greater than 50 percent of total grain projected area and having an average thickness of less than 0.3 micrometer, comprised of the steps of (1) in an aqueous dispersing medium containing a peptizer forming silver halide grain nuclei accounting for from 1 to 10 percent of total silver, having a face centered cubic crystal lattice, and containing crystal lattice dislocations that promote the growth of high chloride {100} tabular grains and (2) introducing into the aqueous dispersing medium silver ions and halide ions that are greater than 50 mole percent chloride ions, based on silver, to grow high chloride {100} tabular grains, wherein during at least one of steps (1) and (2) gelatino-peptizer is present in the dispersing medium that satisfies the formula:

$$(Pro+Hypro)\div(Ser+Thr)=<4.0$$

wherein Pro, Hypro, Ser and Thr represent the proline, hydroxyproline, serine, and threonine amino acid components, respectively, of the gelatino-peptizer.

It has been observed that the presence of the formula gelatino-peptizer results in forming emulsions with higher average grain equivalent circular diameters and higher average tabular grain aspect ratios. When the formula satisfying gelatino-peptizer is present during grain nucleation and contains at least 40 micromoles of methionine per gram of gelatino-peptizer, the high chloride {100} tabular grains account for a high proportion of total grain projected area. When the formula satisfying gelatino-peptizer is present during grain growth and contains <4 micromoles of methionine per gram of gelatino-peptizer, the time required to prepare the emulsion is reduced.

DESCRIPTION OF PREFERRED EMBODIMENTS

This invention is directed to a process for the precipitation of high chloride {100} tabular grain emulsions in which silver halide grain nuclei are formed in the presence of a peptizer under conditions that incorporate crystal lattice dislocations capable of supporting the {100} tabular grain growth. Thereafter these grain nuclei are grown to create high chloride {100} tabular grains.

General processes of this type for precipitating high chloride {100} tabular grain emulsions are disclosed by Maskasky U.S. Pat. No. 5,275,930; House et al U.S. Pat. No. 5,320,938; Brust et al U.S. Pat. No. 5,314,798; Chang et al U.S. Pat. Nos. 5,413,904 and 5,663,041; Olm et al U.S. Pat. No. 5,457,021; Yamashita et al U.S. Pat. Nos. 5,641,620 and 5,652,088; and Oyamada et al U.S. Pat. No. 5,665,530, the disclosures of which are here incorporated by reference. The sole modification of these processes required by the present invention is the substitution in whole or in part of the gelatino-peptizer satisfying Formula (I) below for that described in these patents, although other modifications are also contemplated and, for specific applications, preferred.

It is the discovery of this invention that the presence of gelatino-peptizer satisfying Formula (I) set out below during formation of the grain nuclei or during their subsequent growth into high chloride {100} tabular grains increases the average equivalent circular diameter (ECD) of the high chloride {100} tabular grains and increases their average aspect ratio. Under specific, selected conditions, discussed below, other improvements in the grain structure of the emulsions is also realized.

The gelatino-peptizer required to be present during at least one of nuclei formation and high chloride {100} tabular grain growth satisfies the formula:

$$(\text{Pro}+\text{Hypro})\div(\text{Ser}+\text{Thr})=<4.0 \qquad \text{(I)}$$

wherein Pro, Hypro, Ser and Thr represent the proline, hydroxyproline, serine, and threonine amino acid components, respectively, of the gelatino-peptizer. It is preferred that (Pro+Hypro)÷(Ser+Thr) be <3.5 and, optimally <3.0.

The gelatino-peptizers that satisfy Formula (I) are those derived from the collagen of cold blooded animals, such as reptiles, fish and amphibians. The lowest formula numbers are obtained from the collagen of fish found in cold waters.

To appreciate the significance of the formula numbers it is necessary to appreciate that animal collagen is made up of polymers containing sequences of amino acids. The common naturally occurring amino acids are set out in Table I.

TABLE I

| Amino Acid (symbol) | Formula |
|---|---|
| Glycine (Gly) | $CH_2(NH_2)COOH$ |
| Alanine (Ala) | $CH_3CH(NH_2)COOH$ |
| Valine (Val) | $(CH_3)_2CHCH(NH_2)COOH$ |
| Leucine (Leu) | $(CH_3)_2CHCH_2(NH_2)COOH$ |
| Isoleucine (Leu) | $CH_3CH_2CH(CH_3)CH(NH_2)COOH$ |
| Phenylalanine (Phe) | 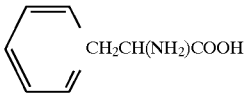 |
| Tyrosine (Thr) | 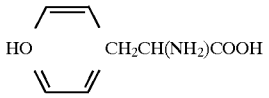 |
| Proline (Pro) | 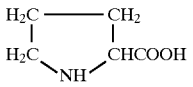 |
| Hydroxyproline (Hypro) | 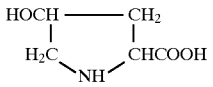 |
| Serine (Ser) | $HOCH_2CH(NH_2)COOH$ |
| Threonine (Thr) | $CH_3CH(OH)CH(NH_2)COOH$ |
| Cysteine (CySH) | $HSCH_2CH(NH_2)COOH$ |
| Cystine (CySScy) | $[-SCH_2CH(NH_2)COOH]_2$ |
| Methionine (Met) | $CH_3SCH_2CH_2CH(NH_2)COOH$ |
| Tryptophan (Try) | 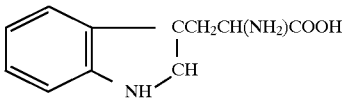 |
| Aspartic acid (Asp) | $HOOCCH_2CH(NH_2)COOH$ |
| Glutamic acid (Glu) | $HOOCCH_2CH_2CH(NH_2)COOH$ |
| Arginine (Arg) | $H_2NC(=NH)NHCH_2CH_2CH_2CH(NH_2)COOH$ |
| Lysine (Lys) | $H_2NCH_2CH_2CH_2CH_2CH(NH_2)COOH$ |
| Histidine (His) | 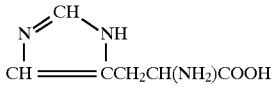 |

The following are published amino acid contents of various collagen sources, amounts being given in grams weight per 1000 grams of total weight:

TABLE II

| | Type (Source) | | | | | | |
|---|---|---|---|---|---|---|---|
| Amino Acid | A(1) | B(2) | C(2) | D(1) | E(3) | F(1&3) | G(1&3) |
| Gly | 320 | 333 | 335 | 317 | 326 | 328 | 345 |
| Ala | 112 | 112 | 117 | 120 | 119 | 114 | 107 |
| Val | 20 | 20 | 22 | 19 | 18 | 18 | 19 |
| Leu | 25 | 23 | 24 | 25 | 22 | 20 | 23 |
| Ileu | 11 | 12 | 11 | 11 | 11 | 9 | 11 |
| Phe | 13 | 12 | 14 | 14 | 14 | 14 | 13 |

TABLE II-continued

| Amino Acid | Type (Source) | | | | | | |
|---|---|---|---|---|---|---|---|
| | A(1) | B(2) | C(2) | D(1) | E(3) | F(1&3) | G(1&3) |
| Tyr | 2.6 | 1.5 | 1.2 | 3.2 | 3.3 | 1.8 | 3.5 |
| Pro | 138 | 129 | 124 | 124 | 117 | 129 | 102 |
| Hypro | 94 | 98 | 93 | 73 | 82 | 70 | 53 |
| Ser | 36 | 36.5 | 33 | 43 | 43 | 41 | 69 |
| Thr | 18 | 17 | 18 | 27 | 25 | 25 | 25 |
| CySH | — | — | — | — | — | — | — |
| CySSCy | <1 | — | — | <1 | <1 | <1 | <1 |
| Met | 4.3 | 5.5 | 3.9 | 12 | 14 | 12 | 13 |
| Try | — | — | — | — | — | — | — |
| Asp | 45 | 46 | 47 | 47 | 48 | 54 | 52 |
| Glu | 72 | 71 | 73 | 74 | 69 | 81 | 75 |
| Arg | 50 | 46 | 48 | 53 | 52 | 45 | 51 |
| Lys | 27 | 28 | 28 | 27 | 25 | 22 | 25 |
| His | 5.0 | 4.5 | 4.2 | 4.5 | 5.2 | 7.4 | 7.5 |
| (Pro + Hypro) / (Ser + Thr) | 4.30 | 4.25 | 4.25 | 2.81 | 2.93 | 3.02 | 1.65 |

A Calf skin collagen
B Ox skin gelatin
C Ox bone gelatin
D Carp skin
E Carp scale
F Pike skin collagen
G Cod skin collagen
(1) Voigt and Botta, Advances in Fisheries Technology and Biotechnology for Increased Profitability, Papers from the 34th Atlantic Fisheries Technological Conference and Seafood Biotechnology Workshop, Aug. 27–Sept. 1, 1989, Technomic Publishing.
(2) Mees, The Theory of the Photographic Process, 3rd Ed., Macmillan, N.Y., 1966, p. 46.
(3) Piez and Gross, "The Amino Acid Composition of Some Fish Collagens: The Relation between Composition and Structure", The Journal of Biological Chemistry, Vol. 265, No. 4, April 1960, pp. 995–998.

From Table II it is apparent that, when the sum of the imino acids Pro and Hypro is divided by the sum of the hydroxy amino acids Ser and Thr, the quotient drops below 4.0 in going from warm blooded animals to cold blooded animals. Further, in comparing carp, pike and cod, the quotient drops as a function of the water temperature in which the fish are found.

This relationship becomes more apparent when the key amino acids Pro, Hypro, Ser and Thr are compared in Table HI for cold blooded animals and fish that are adapted to differing average temperatures. This data is taken from source (3).

TABLE III

| | H | I | J | K | L | M | N | O |
|---|---|---|---|---|---|---|---|---|
| Imino acids | | | | | | | | |
| Pro | 119 | 128 | 110 | 129 | 113 | 102 | 108 | 100 |
| Hypro | 102 | 93 | 78 | 78 | 79 | 82 | 63 | 59 |
| Pro + Hypro | 221 | 221 | 188 | 207 | 192 | 184 | 171 | 159 |
| Hydroxy amino acids | | | | | | | | |
| Ser | 44 | 42 | 66 | 42 | 45 | 50 | 51 | 70 |
| Thr | 18 | 22 | 26 | 24 | 26 | 29 | 27 | 24 |
| Ser + Thr | 62 | 64 | 92 | 66 | 71 | 79 | 78 | 94 |
| (Pro + Hypro) / (Ser + Thr) | 3.6 | 3.5 | 2.0 | 3.1 | 2.7 | 2.3 | 2.2 | 1.7 |

H Python skin
I Crocodile skin
J Toad skin
K Lung fish skin
L Shark skin
M Sturgeon swim bladder
N Halibut skin
O Cod bone Useful molecular weight ranges of gelatino-peptizers satisfying Formula I are generally similar to those currently employed in conventional photographic gelatino-peptizers and can, in any event, be selected by routine investigation. Gelatino-peptizers satisfying Formula I are preferred that are within molecular weight range of from 30,000 to 140,000.

From Table II it can be further noticed that the methionine level of the collagen of cold blooded animals is more than double that of the warm blooded animals. A typical methionine level of slaughter house gelatin is in the range of from 40 to 60 micromoles per gram. Collagen derived from cold blooded animals satisfying Formula (I) in all instances contains at least 40 micromoles per gram of methionine and typically exceeds 100 micromoles per gram.

If desired, the methionine level of the gelatino-peptizer derived from a collagen satisfying the Formula (I) ratio can be reduced by treatment with a strong oxidizing agent, such as hydrogen peroxide. It is specifically contemplated to employ an "oxidized gelatino-peptizer" satisfying the Formula (I) ratio, herein defined as oxidized to reduce methionine to levels of less than 4 micromoles per gram.

It is contemplated to employ gelatino-peptizer satisfying Formula (I) during both grain nuclei formation and during subsequent growth of tabular grains. Alternatively, conventional gelatino-peptizer, that fails to satisfy Formula (I), but satisfies Formula (II), can be employed for either grain nuclei formation or grain growth, but not both:

$$(\text{Pro}+\text{Hypro})\div(\text{Ser}+\text{Thr})=\geqq 4.0 \qquad \text{(II)}$$

The Formula (II) gelatino-peptizer can also be oxidized, if desired, to reduce its methionine content to <4 micromoles per gram.

From the foregoing it is apparent that a variety of choices are available in preparing high chloride {100} tabular grain emulsions according to the invention:

PC-1

In this precipitation choice high (≧40 micromole per gram) methionine Formula (I) gelatino-peptizer is employed during grain nuclei formation while low (<4 micromole per gram) methionine Formula (I) gelatino-peptizer is employed during tabular grain growth.

When this combination is employed, the average ECD of the grains is increased, attributable to the presence of Formula (I) gelatino-peptizer. Further, as demonstrated in the Examples below, it is within the capability of the invention to produce with these choices high chloride {100} tabular grain emulsions in which greater than 95 percent of total grain projected area is accounted for by {100} tabular grains. Finally, the time to prepare the emulsion is reduced by approximately half, as compared to having high methionine Formula (I) gelatino-peptizer present during both grain nuclei formation and tabular grain growth.

PC-2

In this precipitation choice high (≧40 micromole per gram) methionine Formula (I) gelatino-peptizer is employed during grain nuclei formation and during tabular grain growth.

When this combination is employed, the advantages are similar to those described for PC-1, except as noted. A dramatic difference is that the time required to prepare the emulsion is approximately doubled, as compared to PC-1. In addition the tabular grains are slightly thicker. However, mean grain ECD is even larger than in PC-1. The percent projected area of the {100 } tabular grains remains equal to that realized in PC-1.

When PC-1 and PC-2 are compared, it is apparent that, when gelatino-peptizer satisfying Formula (I) is present during grain nucleation and tabular grain growth, the presence of high levels of methionine in the formation of the grain nuclei is in itself sufficient to assure that the tabular grains account for >95% of total grain projected area.

PC-3

In this precipitation choice low (<4 micromole per gram) methionine Formula (I) gelatino-peptizer is employed during grain nuclei formation and during tabular grain growth.

When this combination is employed, the advantages are similar to those described for PC-1, except as noted. A dramatic difference is that a lower percentage (<95%) of total grain projected area is accounted for by {100} tabular grains. Typically {100} tabular grains account for from 80 to 90 percent of total grain projected area. On the other hand the average thickness of the {100} tabular grains is reduced, and the average aspect ratios of the emulsions are increased.

PC-4

In this precipitation choice high (≧40 micromole per gram) methionine Formula (II) gelatino-peptizer is employed during grain nuclei formation and low (<4 micromole per gram) methionine Formula (I) gelatino peptizer is employed during tabular grain growth.

When this combination is compared to employing high methionine Formula (II) gelatino-peptizer for grain nuclei formation and low methionine Formula (II) gelatino-peptizer for grain growth, larger average grain ECD's and higher average aspect ratios are observed for PC-4.

PC-5

In this precipitation choice high (≧40 micromole per gram) methionine Formula (I) gelatino-peptizer is employed during grain nuclei formation and low (<4 micromole per gram) methionine Formula (II) gelatino peptizer is employed during tabular grain growth.

Increased grain average ECD's are realized, attributable to the Formula (I) gelatino-peptizer. The higher methionine in grain nucleation increases the percentage of total grains accounted for by {100} tabular grains. The lower methionine in grain growth reduces average grain thicknesses. The increased average ECD's and reduced average grain thicknesses together result in higher average aspect ratios.

Although the precipitations can be conducted by conventional techniques, apart from gelatino-peptizer selections as noted above, the following more detailed descriptions relate to preferred procedures for preparing high chloride {100} tabular grain emulsions according to the process of the invention.

In a preferred form, the preparation of the high chloride {100} tabular grain emulsion is comprised of a grain nucleation step, wherein a population of grain nuclei are formed. This is followed by a grain renucleation step, wherein a second grain population is formed in the dispersing medium containing the grain nuclei, followed by ripening out of the second grain population onto the grain nuclei, resulting in the growth of high chloride {100} tabular grains.

In a preferred form the process of precipitation according to the invention is initiated by creating silver bromide containing grain nuclei that promote the growth of high chloride {100} tabular grains. The grain nuclei account for 1 to 10 (preferably 3 to 8) percent of total silver present at the conclusion of grain growth. The grain nuclei can be prepared as taught by the Examples of Yamashita et al U.S. Pat. No. 5,641,620 or Oyamada et al U.S. Pat. No. 5,665,530, the disclosures of which are here incorporated by reference. According to these teachings silver chloride is precipitated during formation of the grain nuclei and the concentration of bromide is, after an initial delay, increased and then decreased. This creates a "halide gap" that introduces the crystal lattice dislocations responsible for subsequently promoting {100} tabular grain growth.

A preferred technique for creating grain nuclei containing a halide gap, where bromide ion is employed to create the halide gap, involves first step (a) of precipitating from 5 to 90, preferably 10 to 50, percent of total silver forming the grain nuclei. In this first precipitation the grains formed contain less than 10 mole percent bromide, based on silver, and are free of iodide. Step (a) is followed by step (b), wherein bromide ion is added without further silver ion addition. The bromide ion accounts for from 1 to less than 50 (preferably 5 to 25) mole percent, based on silver added in step (a). After allowing the bromide ion introduced to effect a halide conversion of the grains formed in step (a), a third step (c) is undertaken in which the remainder of the silver forming the grain nuclei is introduced. The halide ion introduced in step (c) is less than 20 (preferably less than 10) mole percent bromide, based on silver introduced during this step. The balance of the halide ion introduced is chloride. No iodide is introduced in step (c). Steps (a), (b) and (c) can be performed under conventional precipitation conditions, but are preferably performed within the parameter limits the emulsion containing the grain nuclei is required to satisfy, set out below.

It is preferred to add with the bromide in step (b) a small amount of iodide. Specifically, it is preferred during step (b) to introduce iodide and bromide ions in an iodide to bromide molar ratio of from $1\times10^{-4}$:1 to $5\times10^{-2}$:1, preferably from $5\times10^{-4}$:1 to $1\times10^{-2}$:1. It has been discovered that introducing iodide and bromide in the indicated molar ratio range results in higher average aspect ratios and, under optimum conditions, thinner tabular grains and tabular grains that account for a higher percentage of total grain projected area. Precipitations that employ the indicated iodide to bromide molar ratios are the specific subject matter of Maskasky et al U.S. Ser. No. 08/977,354, filed Nov. 24, 1997, commonly assigned, titled CHLORIDE, BROMIDE AND IODIDE NUCLEATION OF HIGH CHLORIDE {100} TABULAR GRAIN EMULSION.

Instead of creating the grain nuclei by the halide gap technique taught by Yamashita et al and Oyamada et al, it is alternatively contemplated to employ a simplified technique, which forms high bromide grain nuclei. According to this technique, during the grain nucleation step grain nuclei are formed that contain greater than 50 mole percent bromide, based on silver, and preferably consist essentially of silver bromide. The grain nuclei are preferably regular grains and preferably monodisperse, exhibiting a grain size coefficient of variation (COV) of less than 25 percent and, optimally, less than 15 percent.

The high bromide grain nuclei process differs from that of Yamashita et al and Oyamada et al in that it is unnecessary to build any crystal lattice dislocations into the grain nuclei, since the necessary crystal lattice dislocations are created when the first subsequent grain growth occurs depositing silver halide that contains more than 50 mole percent chloride, based on silver. Thus, this technique allows any conventional high bromide regular grain population to serve as grain nuclei and thereby simplifies the step of forming grain nuclei. This approach to grain nuclei formation is the specific subject matter of Chang et al U.S. Ser. No. 08/975,906, filed Nov. 21, 1997, commonly assigned, titled A SIMPLIFIED NUCLEATION OF HIGH CHLORIDE TABULAR GRAIN EMULSIONS.

The emulsion containing the grain nuclei can be transferred from the reaction vessel in which it is formed to a larger reaction vessel for the subsequent step of grain growth. Alternatively, precipitation can continue following grain nuclei formation in the original reaction vessel.

Before the renucleation step, the emulsion containing the grain nuclei is brought within certain parameter limits, if they are not already satisfied.

The temperature of the emulsion in the reaction vessel is adjusted to the range of from 35 to 50° C. pH is adjusted to the range of from 3.5 to 7 (preferably from 5.0 to 6.5). pH adjustment can be accomplished by employing a base, such as an alkali hydroxide, or a mineral acid, such as $HNO_3$. If desired, a buffering agent can be introduced to increase the ease of maintaining the emulsion within the indicated pH range.

During formation of the grain nuclei preferred concentrations of gelatino-peptizer that contains at least 40 micromoles of methionine per gram during the grain nuclei formation step are in the range of from 0.5 to 5.0 grams per mole of silver present at the completion of the grain renucleation step. Preferred concentrations of gelatino-peptizer that contains less than 4 micromoles of methionine per gram during the grain nuclei formation step are in the range of from 1.0 to 60.0 grams per mole of silver present at the completion of the grain renucleation step.

The grain nuclei, once formed according to the teachings of this invention can be used as hosts for the growth of high chloride {100} tabular grains following conventional grain growth practices, such as those disclosed in the patents cited and incorporated by reference above.

A preferred growth procedure is that disclosed in Maskasky et al U.S. Ser. No. 08/976,321, filed Nov. 21, 1997, commonly assigned, titled A PROCESS OF PREPARING HIGH CHLORIDE {100} TABULAR GRAIN EMULSIONS. With the grain nuclei emulsion in the temperature range of from 35 to 50° C., pH in the range of from 3.5 to 7.0, vAg in the range of from 105 to 260 mV, preferably 140 to 200 mV, and gelatino-peptizer as indicated above, the growth of high chloride {100} tabular grains is initiated by a renucleation step, wherein the balance of the silver and halide ion to be incorporated in the photographically useful emulsion is introduced. The silver ion introduced accounts for from 90 to 99 (preferably 92 to 97) percent of total silver in the photographically useful emulsion. Halide ion is introduced as required to satisfy the vAg range limits noted above.

Preferably silver ion is introduced in the renucleation step in the form of any convenient conventional soluble salt solution—e.g., a silver nitrate salt solution. Similarly, the halide ion is introduced in the form of any convenient conventional soluble salt solution—e.g., an alkali halide salt solution. Alternatively the silver and halide ions can be introduced in the form of a fine grain emulsion. For example, when chloride is the sole halide in the fine grains, these grains can be easily ripened out in grain sizes of up to 0.20 $\mu$m mean ECD. Fine bromochloride grains containing just greater than 50 mole percent chloride, based on silver, can be easily ripened out in grain sizes of up to 0.10 $\mu$m mean ECD.

One of the surprising advantages that has been realized is that more concentrated emulsions can be prepared by silver and halide ion addition according the preferred preparation procedure. The concentrations of the silver and halide ions introduced in the addition are regulated to create a total volume of emulsion in the range of from 0.7 to 2.0 liters per silver mole. The advantage of limiting the volume of the emulsion in relation to the silver ion is that the emulsion generating capacity of the reaction vessel is increased.

The halide introduced during the renucleation step is chosen so that chloride accounts for greater than 50 mole percent, based on silver, of total halide in the reaction vessel. Since only very small concentrations of bromide and iodide are required for grain nucleation, it is appreciated that the chloride concentration can exceed 99 mole percent, based on silver. The balance of the halide not accounted for by chloride, if any, is preferably bromide. It is preferred to avoid the introduction of iodide ion during the renucleation step, although significant concentrations of iodide can be added later in the subsequent ripening step, if desired.

More gelatino-peptizer can be added during the renucleation step, if necessary. The concentration of gelatino-peptizer employed to peptize the emulsion being formed through the growth step ranges from 10 to 60 grams per mole of silver present at the conclusion of the renucleation step. Thus, it is apparent that, when the gelatin containing less than 4 micromoles per gram of methionine is employed during grain nuclei formation, gelatin concentrations can be employed that allow grain renucleation to be completed without further gelatino-peptizer addition. As previously indicated, when gelatino-peptizer containing at least 40 micromoles of methionine per gram is employed during formation of the grain nuclei, it is advantageous to incorporate additional gelatino-peptizer containing less than 4 micromoles of methionine per gram during the renucleation step to reduce the time required for ripening. Both forming grain nuclei and performing the renucleation step in the presence gelatino-peptizer that contains less than 4 micromoles methionine per gram is particularly advantageous in that rapid rates of ripening can be realized without further gelatino-peptizer addition, thereby simplifying the preparation process.

The addition of halide ion and the balance of the silver ion during the renucleation step creates a second grain population within the dispersing medium. Growth of the high chloride {100} tabular grains is driven by temperature as the ripening out of the second grain population occurs, thereby redepositing the silver halide from the second grain population onto the grain nuclei that contain crystal lattice dislocations favorable for {100} tabular grain growth. Ideally the ripening out process is terminated as the last remaining grains of the second grain population are ripened out. If ripening is continued beyond this point, the comers of the high chloride {100} tabular grains become progressively more rounded and the tabular grains increase in thickness. Corner rounding is common in high chloride {100} tabular grain emulsions and is not objectionable in the process. Hence the termination of ripening is dictated by the maximum thickness of the tabular grains that can be tolerated for the intended photographic application. It is preferred as a practical matter to discontinue grain ripening just after depleting the second grain population.

To facilitate ripening of the second grain population and hence growth of the high chloride {100} tabular grains, the temperature of the dispersing medium is increased following the addition step. A temperature in the range of from 60° to 95° C. (preferably 65° to 85° C.) is contemplated. The purpose of raising the temperature is to accelerate the rate of ripening. At temperatures below 60° C. the rate of ripening is unacceptably slow.

It has been observed that, in addition to raising the temperature to accelerate ripening, maintaining a vAg in the range of from 105 to 140 mV increases the rate of ripening, with the rate of ripening increasing as vAg decreases. Thus, employing a gelatino-peptizer containing less than 4 micromoles of methionine per gram in a dispersing medium maintained at a vAg of from 105 to 140 mV and at an elevated temperature, as noted above, results in the most accelerated rates of ripening.

Whereas Yamashita et al and Oyamada et al, cited above, introduce silver and halide ion consumed during grain growth following temperature elevation to drive ripening, it has been discovered quite surprisingly that superior high chloride {100} tabular grain characteristics are realized when silver ion addition is completed prior to elevating temperature to drive grain ripening.

It is, in fact, preferred to introduce all of the silver ion into the dispersing medium before any substantial growth of the grain nuclei can occur. Thus, rapid silver and halide ion additions preceding raising the temperature of the dispersing medium are preferred. So called "dump" additions are preferred—that is, the rate of addition is the maximum that the operating equipment will permit and is not intentionally limited. Completion of silver ion addition in less than 15 minutes is contemplated.

The high chloride {100} tabular grain emulsions obtained at the conclusion of the ripening step contain greater than 50 mole percent chloride, preferably at least 70 mole chloride, and optimally at least 90 mole percent chloride, based on silver. Bromide preferably accounts for the balance of the halide.

Although iodide ion is limited in the preferred procedure in the earlier stages of emulsion preparation, as indicated above, it is possible to incorporate significant iodide concentrations in the latter stages of ripening. Alternatively, after the ripening process described above is completed without iodide addition, iodide can be incorporated in a subsequent conventional step of grain growth involving iodide ion addition and further ripening or by the introduction of additional silver and halide ion, including iodide ion. Iodide levels are preferably limited to less than 10 (most preferably less than 5) mole percent, based on silver. Since iodide is known to limit processing rates, one of generally sought advantages of employing high chloride emulsions, it is preferred that iodide in the grains be limited. For example, the grains are preferably free of iodide concentrations above the low levels shown to be useful during grain nuclei formation.

It is recognized in the art that introducing crystal lattice dislocations at the edge of tabular grains increases their speed without increasing their granularity. Tabular grains emulsions that contain peripheral crystal lattice dislocations are disclosed by Wilgus et al U.S. Pat. No. 4,434,226, Kofron et al U.S. Pat. No. 4,439,520, Solberg et al U.S. Pat. No. 4,433,048, Ikeda et al U.S. Pat. No. 4,806,461, Takahara et al U.S. Pat. No. 5,068,173, Haga et al U.S. Pat. No. 5,472,836, Suga et al U.S. Pat. No. 5,550,012, and Maruyama et al U.S. Pat. No. 5,550,014, the disclosures of which are here incorporated by reference. The addition of iodide ion at the late stages of ripening, preferably when less than 20 (preferably <10) percent but at least 0.5 (preferably 1.0) percent of total silver remains in the second grain population, is capable of increasing the speed of the emulsions obtained at the conclusion of ripening. It is contemplated to release iodide ion in the dispersing medium during ripening by adding elemental iodine, as disclosed in Maskasky et al U.S. Ser. No. 08/955,867, filed Oct. 21, 1997, commonly assigned, titled HIGH CHLORIDE TABULAR GRAIN EMULSIONS AND PROCESSES FOR THEIR PREPARATION. Alternatively, iodide ion can be released in the dispersing medium during ripening by adding an organic iodide ion source compound with a maximum second order reaction rate constant of less than $1\times10^3$ $mole^{-1}$ $sec^{-1}$, as disclosed in Maskasky et al U.S. Ser. No. 08/961,962, filed Oct. 31, 1997, commonly assigned titled A PROCESS OF PREPARING HIGH CHLORIDE {100} TABULAR GRAIN EMULSIONS. Specific illustrations of organic iodide ion source compounds are provided by Suga et al and Takahara et al.

The high chloride {100} tabular grain emulsions produced by the process of the invention can satisfy known grain characteristics, such as mean ECD, average tabular grain thicknesses, average tabular grain aspect ratios and percent total grain projected area accounted for by {100} tabular grains. The process of the present invention is particularly advantageous for forming emulsions with higher average ECD's of at least 2.0 (most preferably at least 3.0)μm. The average grain ECD's of emulsions prepared according to the process of the invention can be up to the highest limits of photographic utility, usually considered to be about 10 μm, but are usually less than about 5 μm. The tabular grains are contemplated to have average thicknesses less than 0.3 μm and preferably less than 0.2 μm.

It is generally preferred that the {100} tabular grains account for the highest attainable percent of total grain projected area. It is preferred that the {100} tabular grains at the conclusion of the ripening step account for at least 70 percent and optimally at least 90 percent of total grain projected area.

Once formed, the high chloride {100} tabular grain emulsions can be sensitized, combined with conventional photographic addenda, and coated in any conventional manner, as is further illustrated by the following patents disclosing high chloride tabular grain emulsions and their use, here incorporated by reference:

Maskasky U.S. Pat. No. 5,264,337;
Maskasky U.S. Pat. No. 5,275,930;
Maskasky U.S. Pat. No. 5,292,632;
Brust et al U.S. Pat. No. 5,314,798;
House et al U.S. Pat. No. 5,320,938;
Szajewski et al U.S. Pat. No. 5,356,764;
Chang et al U.S. Pat. No. 5,413,904;
Oikawa U.S. Pat. No. 5,654,133;
Budz et al U.S. Pat. No. 5,451,490;

Olm et al U.S. Pat. No. 5,457,021;

Brennecke U.S. Pat. No. 5,498,518;

Yamashita U.S. Pat. No. 5,565,315;

Saitou et al U.S. Pat. No. 5,587,281;

Oyamada U.S. Pat. No. 5,593,821;

Yamashita et al U.S. Pat. No. 5,641,620;

Yamashita et al U.S. Pat. No. 5,652,088;

Saitou et al U.S. Pat. No. 5,652,089;

Oikawa U.S. Pat. No. 5,654,133; and

Chang et al U.S. Pat. No. 5,663,041.

Generally preparing the emulsions for use following precipitation begins with emulsion washing. This is in turn followed by chemical and spectral sensitization. Antifoggant and stabilizer addition is usually also undertaken. The emulsions are also combined with additional levels of vehicle before coating. Hardener is added to one or more vehicle layers just before coating. The emulsions are contemplated for use in both black-and-white (silver image forming) and color (dye image forming) photographic elements. The emulsions can be incorporated in radiographic and black-and-white photographic elements. The emulsions can also be incorporated in color print, color negative or color reversal elements. The following paragraphs of *Research Disclosure*, Vol. 389, September 1996, Item 38957, illustrate conventional photographic features compatible with the emulsions of the invention:

I. Emulsion grains and their preparation E. Blends, layers and performance categories II. Vehicles, vehicle extenders, vehicle-like addenda and vehicle related addenda III. Emulsion washing IV. Chemical sensitization V. Spectral sensitization and desensitization VII. Antifoggants and stabilizers IX. Coating physical property modifyingaddenda X. Dye image formers and modifiers XI. Layer arrangements XV. Supports XVIII. Chemical development systems

EXAMPLES

The invention can be better appreciated by reference to the following examples.

References to (a) "high methionine fish gelatin" indicate gelatin derived from the skins of cold water fish having a Formula (I) ratio of less than 2, a methionine content of 100 micromoles methionine per gram (with oxidized and therefore inactive methionine accounting for an additional 61 micromoles per gram), and a weight average molecular weight of 86,000;

(b) "high methionine bone gelatin" indicate gelatin derived from cattle bone satisfying Formula (II)—i.e., having a ratio of greater than 4, a methionine content of 58 micromoles per gram, and a weight average molecular weight of 140,000;

(c) "low methionine" bone gelatin indicate the bone gelatin of (b) treated with an oxidizing agent to reduce its methionine content to less than 4 micromoles per gram; and (d) "low methionine" fish gelatin indicate gelatin derived from the skins of cold water fish satisfying Formula (I)—i.e., having ratio of less than 2, a methionine content of less than 4 micromoles per gram, and a weight average molecular weight of 91,000.

The total make time was the total time elapsed from nucleation until the grains formed by renucleation disappeared in ripening.

Example Set I

This example set compares emulsion precipitations employing high methionine fish gelatin throughout the precipitation process with a control employing high methionine bone gelatin.

Example 1

A vigorously stirred reaction vessel containing 2400 mL of a solution which was 0.42 wt % in high methionine fish gelatin (HFG-2) and 0.014M in NaCl was adjusted to pH 4.0 at 40° C. To this solution at 40° C. were added simultaneously for 15 sec, 1.25M $AgNO_3$ solution and 1.27M NaCl solution at a rate of 120 mL per min. After the mixture was held for 2 min, 50 mL of 0.10M NaBr solution was added at a rate of 100 mL per min followed by another 2 min hold. Then the $AgNO_3$ and NaCl solutions were simultaneously added at 120 mL per min for 1 min. After a 2 min hold, 500 mL of a 26 wt % solution of the fish gelatin (HFG-2) was added and the pH was adjusted to 5.50. Then at 40° C., 4.0M $AgNO_3$ solution was added at 120 mL per min (~0.2 mole Ag per liter of emulsion per min) while maintaining the pH at 5.50 and the silver ion potential (vAg) at 155 mV (with reference to a saturated AgCl electrode at room temperature) by the concurrent addition of 4.0M NaCl solution. When 1 L of the 4M $AgNO_3$ solution had been added, the additions were stopped. The mixture was heated to 85° C. at the rate of 3.3° C. per min and the vAg was maintained at 155 mV by the addition of NaCl solution and the pH was maintained at 5.5. After reaching 85° C., 4M NaCl was added to change the vAg to 130 mV at a rate of 2 mV per min. Then the emulsion was held at 85° C. for 120 min, the minimum time needed to ripen away the fine grain population.

The resulting high chloride emulsion was comprised of tabular grains having {100} major faces accounting for 98% of the projected area of the total grain population. The mean grain ECD of the emulsion was 3.8 $\mu$m. The tabular grains exhibited an average thickness of 0.26 $\mu$m and an average aspect ratio of 15. The yield of unwashed emulsion was 1.3 liters of emulsion per mole Ag.

Significant parameters are summarized in Table IV.

Example 2 (Comparison)

A vigorously stirred reaction vessel containing 2400 mL of a solution which was 0.42 wt % in deionized high methionine bone gelatin and 0.014M in NaCl was adjusted to pH 4.0 at 40° C. To this solution at 40° C. were added simultaneously for 15 sec, 1.25M $AgNO_3$ solution and 1.27M NaCl solution at a rate of 120 mL per min. The mixture was stirred for 2 min then 50 mL of 0.10M NaBr solution was added at a rate of 100 mL per min. followed by another 2 min hold. Then the $AgNO_3$ and NaCl solutions were simultaneously added at 120 mL per min for 1 min. After a 2 min hold, 500 mL of a 26% solution of the high methionine gelatin was added and the pH was adjusted to 5.50. Then at 4° C., 4.0M $AgNO_3$ solution was added at 120 mL per min (~0.2 mole Ag per L of emulsion per min) while maintaining the pH at 5.50 and the silver ion potential (vAg) at 155 mV by the concurrent addition of 4.0M NaCl solution. When 1 L of the 4M $AgNO_3$ solution had been added, the additions were stopped. The mixture was heated to 75° C. at the rate of 1.7° C. per min and the vAg was maintained at 155 mV by the addition of NaCl solution and the pH was maintained at 5.5. When the emulsion reached 75° C., 4M NaCl solution was added to change the vAg from 155 mV to 130 mV at a rate of 2 mV per min and then held at this vAg for 135 min, the minimum time needed to ripen away the fine grain population.

The resulting high chloride emulsion was comprised of tabular grains having {100} major faces that accounted for 93% of the projected area of the total grain population. The mean grain ECD of the emulsion was 2.0 μm. The tabular grains exhibited an average thickness of 0.17 μm and an average aspect ratio of 12. The yield of unwashed emulsion was 1.3 liters of emulsion per mole Ag.

Significant parameters are summarized in Table IV.

Example 3

This example was prepared similarly to that of Example 1, except that after heating to 85° C., the emulsion was held at a vAg of 155 mV for 270 min.

The resulting high chloride emulsion was comprised of tabular grains having {100} major faces that accounted for 98% of the projected area of the total grain population. The mean grain ECD of the emulsion was 4.2 μm. The tabular grains exhibited an average thickness of 0.20 μm and an average aspect ratio of 21. The yield of unwashed emulsion was 1.3 liters of emulsion per mole Ag.

Significant parameters are summarized in Table IV.

120 mL per min. After the mixture was held for 2 min, 50 mL of 0.10M NaBr solution was added at a rate of 100 mL per min followed by another 2 min hold. Then the $AgNO_3$ and NaCl solutions were simultaneously added at 120 mL per min for 1 min.

After a 2 min hold, 500 mL of a 26 wt % solution of low methionine (3 μmole per g gelatin) fish gelatin was added, and the pH was adjusted to 5.50. Then at 40° C., 4.0M $AgNO_3$ solution was added at 120 mL per min (~0.2 mole Ag per liter of emulsion per min) while maintaining the pH at 5.50 and the silver ion potential (vAg) at 155 mV by the concurrent addition of 4.0M NaCl solution. When 1 L of the 4M $AgNO_3$ solution had been added, the additions were stopped. The mixture was heated to 85° C. at the rate of 3.3° C. per min and the vAg was maintained at 155 mV by the addition of NaCl solution and the pH was maintained at 5.5. The emulsion was held at 85° C. for 130 min, the minimum time needed to ripen away the fine grain population.

The resulting high chloride emulsion was comprised of tabular grains having {100} major faces that accounted for 98% of the projected area of the total grain population. The mean grain ECD of the emulsion was 3.8 μm. The tabular grains exhibited an average thickness of 0.17 μm and an average aspect ratio of 22. The yield of unwashed emulsion was 1.3 liters of emulsion per mole Ag.

Except for the substitution of low methionine fish gelatin for grain growth, the procedure was identical to that of Example 3. Referring to Table IV above, it is apparent that all of the advantages of Example 3 were retained while the overall time of making was cut almost in half by the higher rate of ripening permitted by the low methionine gelatin. Additionally, the average thickness of the tabular grains was decreased, and the average aspect ratio of the tabular grains was increased.

TABLE IV

| Example (Comparison) | Gelatino-Peptizer (formula ratio) | Methionine (μM/gram) | Total make time (min) | Yield (liters of emulsion per mole Ag) | Average ECD (μm) | Average thickness (μm) | Average aspect ratio | Tabular Grain % of Total Projected Area |
|---|---|---|---|---|---|---|---|---|
| 1 | fish (<2) | 100 | 159 | 1.3 | 3.8 | 0.26 | 15 | 98 |
| (2) | bone (>4) | 58 | 185 | 1.3 | 2.0 | 0.17 | 12 | 93 |
| 3 | fish (<2) | 100 | 309 | 1.3 | 4.2 | 0.20 | 21 | 98 |
| 4 | fish (<2) | 100 & 3 | 159 | 1.3 | 3.8 | 0.17 | 22 | 98 |

From Table IV it is apparent that the high methionine fish gelatin, employed both during grain nucleation and growth, produced emulsions in which greater than 95 percent of total grain projected area was accounted for by high chloride {100} tabular grains. Also, the average grain ECD resulting from using the fish gelatin was much greater than that realized employing the bone gelatin. The average aspect ratios of the emulsions prepared in the presence of the high methionine fish gelatin were also higher.

Example Set II

This example set compares an emulsion precipitation employing high methionine fish gelatin for grain nucleation and low methionine fish gelatin for grain ripening with Example 3, which employed high methionine fish gelatin throughout the precipitation process.

Example 4

A vigorously stirred reaction vessel containing 2400 mL of a solution which was 0.42 wt % in fish gelatin (HFG-2) and 0.014M in NaCl was adjusted to pH 4.0 at 40° C. To this solution at 40° C. were added simultaneously for 15 sec, 1.25M $AgNO_3$ solution and 1.27M NaCl solution at a rate of Example Set III This example set compares emulsion precipitations employing low methionine fish gelatin throughout the precipitation process with a control employing low methionine bone gelatin.

General Nucleation Procedure

A vigorously stirred reaction vessel containing 2400 mL of a solution which was 6.0 wt % in low methionine fish gelatin and 0.014M in NaCl was adjusted to pH 4.0 at 40° C. (See Optimal pH Determination given below.) To this solution at 40° C. were added simultaneously for 15 sec, 1.25M $AgNO_3$ solution and 1.27M NaCl solution at a rate of 120 mL per min. The mixture then was held for 2 min then 50 mL of 0.10M NaBr solution was added at a rate of 100 mL per min followed by another 2 min hold. Then the $AgNO_3$ and NaCl solutions were simultaneously added at 120 mL per min for 1 min. After a 2 min hold, the pH was adjusted to 5.50 at 40° C. with dilute NaOH solution.

Optimal pH Determination (nucleation and growth)

The above General Nucleation Procedure was repeated 6 times, but using each time 2400 mL of a solution that was 2.08 wt % in the low methionine fish gelatin and 0.014M in NaCl adjusted to pH's of 5.0, 4.5, 4.0, 3.5, 3.0, and 2.0. Then after the pH adjustment to 5.50, the six emulsions were heated to 75° C. and stirred at this temperature for 60 min.

The final six seed emulsions (containing only 0.068 mole Ag per liter of emulsion) had the following % of projected area as tabular grain nuclei, and average tabular grain nuclei thickness: pH 5.0, 30%, 0.13 μm; pH 4.5, 83%, 0.12 μm; pH 4.0, 90%, 0.13 μm; pH 3.5, 80%, 0.16 μm; pH 3.0, 70%, 0.17 μm; and pH 2.0, 60%, 0.16 μm. Based on the percent of total grain projected area accounted for by tabular grains, the optimal nucleation was at a pH range of 3.0 to 4.5.

Example 5

Two minutes after the nucleation, 4.0M $AgNO_3$ solution was added at 120 mL per min (~0.2 mole Ag per min per liter of emulsion) at 40° C. while maintaining a pH of 5.50 and a silver ion potential (vAg) of 155 mV by the concurrent addition of 4.0M NaCl solution. When 1 L of 4M $AgNO_3$ solution had been added, the additions were stopped. The mixture was heated to 75° C. at a rate of 3.3° C. per min and the vAg was maintained at 155 mV by the addition of NaCl solution and the pH was maintained at 5.5. The emulsion was stirred at 75° C. for 295 min, the minimum time needed to ripen away the fine grain population.

The resulting high chloride emulsion was comprised of tabular grains having {100} major faces that accounted for 87% of the projected area of the total grain population. The mean grain ECD of the emulsion was 3.7 μm. The tabular grains exhibited an average thickness of 0.14 μm and an average aspect ratio of 26. The yield of unwashed emulsion was 1.1 liters of emulsion per mole Ag.

Significant parameters are summarized in Table V.

Example 6 (Comparison)

This emulsion was made similarly to that of Example 5, except that oxidized bone gelatin (0.1 μmole methionine per g gelatin) was used in place of the fish gelatin for grain nucleation and growth and the nucleation pH was 3.0 (an optimal value for low methionine bone gelatin). The resulting emulsion was stirred at 75° C. for 90 min, the minimum time needed to ripen away the fine grain population.

The resulting high chloride emulsion was comprised of tabular grains having {100} major faces that accounted for 85% of the projected area of the total grain population. The mean grain ECD of the emulsion was only 1.8 μm. The tabular grains exhibited an average thickness of 0.12 μm and an average aspect ratio of 15. The yield of unwashed emulsion was 1.1 liters of emulsion per mole Ag.

Significant parameters are summarized in Table V.

Example 7

This emulsion was made similarly to that of Example 1, except that 50 mL of 0.133M NaBr solution was substituted for the 0.10M NaBr solution used in the Nucleation Procedure. The emulsion was stirred at 75° C. for 215 min, the minimum time needed to ripen away the fine grain population.

The resulting high chloride emulsion was comprised of tabular grains having {100} major faces that accounted for 82% of the projected area of the total grain population. The mean grain ECD of the emulsion was 3.3 μm. The tabular grains exhibited an average thickness of 0.12 μm and an average aspect ratio of 28. The yield of unwashed emulsion was 1.1 liters of emulsion per mole Ag.

Significant parameters are summarized in Table V.

Example 8

This emulsion was made similarly to that of Example 7, except that after the concurrent addition of the 4M $AgNO_3$ and 4M NaCl solutions at 40° C., the emulsion was heated to 85° C. at a rate of 3.3° C. per min then stirred at 85° C. for 120 min, the minimum time needed to ripen away the fine grain population.

The resulting high chloride emulsion was comprised of tabular grains having {100} major faces that accounted for 82% of the projected area of the total grain population. The mean grain ECD of the emulsion was 3.2 μm. The tabular grains exhibited an average thickness of 0.12 μm and an average aspect ratio of 27. The yield of unwashed emulsion was 1.1 liters of emulsion per mole Ag.

Significant parameters are summarized in Table V.

TABLE V

Low methionine during grain nucleation and growth

| Example (Comparison) | Gelatino-Peptizer Nucleation (formula ratio) | Gelatino-Peptizer Growth (formula ratio) | Total make time (min) | Yield (liters of emulsion per mole Ag) | Average ECD (μm) | Average thickness (μm) | Average aspect ratio | Tabular Grain % of Total Projected Area |
|---|---|---|---|---|---|---|---|---|
| 5 | fish (<2) | fish (<2) | 323 | 1.1 | 3.7 | 0.14 | 26 | 87 |
| (6) | bone (>4) | bone (>4) | 147 | 1.1 | 1.8 | 0.12 | 15 | 85 |
| 7 | fish (<2) | fish (<2) | 244 | 1.1 | 3.3 | 0.12 | 28 | 82 |
| 8 | fish (<2) | fish (<2) | 161 | 1.1 | 3.2 | 0.12 | 27 | 82 |

Comparing the use of low methionine bone gelatin to low methionine fish gelatin during growth in Table V, it is apparent that the fish gelatin produced the highest average grain ECD's and the highest average aspect ratios.

Comparing the use of low methionine fish gelatin in Table V to the use of high methionine fish gelatin for total precipitation or only nucleation, it is apparent that higher percentages of total grain projected area were accounted for by high chloride {100} tabular grains when the peptizer employed for nucleation contained high levels of methionine. However, when low methionine was employed at nucleation, the percent projected area remained above 80 percent. Further, thinner tabular grains were obtained when low methionine gelatin was employed during nucleation and growth.

Example Set IV

This example set uses emulsion precipitations employing low methionine fish gelatin throughout the precipitation process as set out in the previous set with the variation of adding silver and halide solutions at 75° C.

Example 9

A vigorously stirred reaction vessel containing 2400 mL of a solution which was 6.0 wt % in low methionine fish gelatin and 0.014M in NaCl was adjusted to pH 4.0 at 40° C. (See Optimal pH Determination given in previous set.) To this solution at 40° C. were added simultaneously for 15 sec, 1.25M $AgNO_3$ solution and 1.27M NaCl solution at a rate of 120 mL per min. The mixture was stirred for 2 min then 50 mL of 0.10M NaBr solution was added at a rate of 100 mL per min. followed by a 2 min hold. Then the $AgNO_3$ and NaCl solutions were simultaneously added at 120 mL per min for 1 min. After a 2 min hold, the pH was adjusted to 5.50 at 40° C. with dilute NaOH solution.

Then 630 mL of a 1.25M $AgNO_3$ solution was added at 30 mL per min while the temperature was increased from 40° C. to 75° C. at a rate of 1.67° C. per min maintaining a pH of 5.50 and a silver ion potential (vAg) of 155 mV (with reference to a saturated AgCl electrode at room temperature) by the simultaneous addition of 1.27M NaCl solution. This pH and vAg were maintained throughout the rest of the procedure. Then a 4M $AgNO_3$ solution was added initially at a flow rate of 10 mL per min and accelerated at a rate of 3 mL/min$^2$ during 20 min maintaining the vAg by the concurrent addition of a 4M NaCl solution. When 803 mL of 4M $AgNO_3$ solution had been added, the additions were stopped and the mixture was stirred for 360 min, the minimum time needed to ripen away the fine grain population.

The resulting high chloride emulsion was comprised of tabular grains having {100} major faces that accounted for 90% of the projected area of the total grain population. The mean grain ECD of the emulsion was 3.7 μm. The tabular grains exhibited an average thickness of 0.17 μm and an average aspect ratio of 22. The yield of unwashed emulsion was 1.3 liters of emulsion per mole Ag.

Significant parameters are summarized in Table VI.

Example 10

This emulsion was made similarly to that of Example 9, except that following the nucleation procedure, the mixture was heated from 40° C. to 75° C. at a rate of 3.3° C. per min while maintaining a pH of 5.5, and a vAg of 155 mV by adding a small amount of 4M NaCl solution. The mixture was stirred for 20 min at 75° C. to form the tabular grain nuclei. Then the 1.25M $AgNO_3$ solution was added at 30 mL per min for 21 min and the 1.27M NaCl solution was concurrently added to maintain a vAg of 155 mV. The 4M $AgNO_3$ and 4M NaCl solutions were added as in Example 1. After the additions were complete, the emulsion was heated at 75° C. for 150 min, the minimum time needed to ripen away the fine grain population.

The resulting high chloride emulsion was comprised of tabular grains having {100} major faces that accounted for 92% of the projected area of the total grain population. The mean grain ECD of the emulsion was 3.1 μm. The tabular grains exhibited an average thickness of 0.27 μm and an average aspect ratio of 11. The yield of unwashed emulsion was 1.3 liters of emulsion per mole Ag.

Significant parameters are summarized in Table VI.

TABLE VI

| Example | Seed ripening time at elevated temp prior to growth (min at °C.) | Temp at start of growth Ag addition (°C.) | Total make time (min) | Yield (liters of emulsion per mole Ag) | Average ECD (μm) | Average thickness (μm) | Average aspect ratio | Tabular Grain % of Total Projected Area |
|---|---|---|---|---|---|---|---|---|
| 9 | none | 40 | 409 | 1.3 | 3.7 | 0.17 | 22 | 90 |
| 10 | 20 at 75 | 75 | 254 | 1.3 | 3.1 | 0.27 | 11 | 92 |

Although both Examples 9 and 10 produced high chloride {100} tabular grain emulsions satisfying invention requirements, the preferred procedure of Example 9, which did not increase temperature prior to forming the second grain population, produced a higher average grain ECD, a lower tabular grain thickness, and a higher average aspect ratio.

Example Set V

This example set compares an emulsion prepared using high methionine bone gelatin for nucleation and low methionine fish gelatin for growth with an emulsion prepared using high methionine bone gelatin for nucleation and low methionine bone gelatin for growth.

Example 11

A vigorously stirred reaction vessel containing 2400 mL of a solution which was 0.42 wt % in deionized high methionine bone gelatin and 0.014M in NaCl was adjusted to pH 4.0 at 40° C. (See Optimal pH Determination in Set III.) To this solution at 40° C. were added simultaneously for 15 sec, 1.25M $AgNO_3$ solution and 1.27M NaCl solution at a rate of 120 mL per min. After the mixture was held for 2 min, 50 mL of 0.10M NaBr solution was added at a rate of 100 mL per min followed by another 2 min hold. Then the $AgNO_3$ and NaCl solutions were simultaneously added at 120 mL per min for 1 min.

After a 2 min hold, 500 mL of a 26 wt % solution of high molecular weight, oxidized fish gelatin was added, and the pH was adjusted to 5.50. Then at 40° C., 4.0M $AgNO_3$ solution was added at 120 mL per min (~0.2 mole Ag per liter of emulsion per min) while maintaining the pH at 5.50 and the silver ion potential (vAg) at 155 mV by the concurrent addition of 4.0M NaCl solution. When 1 L of the 4M $AgNO_3$ solution had been added, the additions were stopped. The mixture was heated to 75° C. at the rate of 1.7° C. per min and the vAg was maintained at 155 mV by the addition of NaCl solution and the pH was maintained at 5.5. The emulsion was held at 75° C. for 300 min, the minimum time needed to ripen away all but 3% of the projected surface area of the fine grain population.

The resulting high chloride emulsion was comprised of tabular grains having {100} major faces that accounted for 90% of the projected area of the total grain population. The mean grain ECD of the emulsion was 4.4 μm. The tabular grains exhibited an average thickness of 0.13 μm and an average aspect ratio of 34. The yield of unwashed emulsion was 1.3 liters of emulsion per mole Ag.

Significant parameters are summarized in Table VII.

Example 12 (Comparison)

This comparison example was prepared similarly to that of Example 11, except that low methionine bone gelatin was used in place of the fish gelatin during grain growth. The emulsion was held at 75° C. for 210 min, the minimum amount of time needed to ripen away the fine grain population.

The resulting high chloride emulsion was comprised of tabular grains having {100} major faces that accounted for 95% of the projected area of the total grain population. The mean grain ECD of the emulsion was 3.0 μm. The tabular grains exhibited an average thickness of 0.15 μm and an average aspect ratio of 20. The yield of unwashed emulsion was 1.3 liters of emulsion per mole Ag.

Significant parameters are summarized in Table VII.

TABLE V

| Example (Comparison) | Gelatino-Peptizer Nucleation (methionine μM/gram) | Gelatino-Peptizer Growth (methionine μM/gram) | Total make time (min) | Yield (liters of emulsion per mole Ag) | Average ECD (μm) | Average thickness (μm) | Average aspect ratio | Tabular Grain % of Total Projected Area |
|---|---|---|---|---|---|---|---|---|
| 11 | bone (58) | fish (<4) | 337 | 1.3 | 4.4 | 0.13 | 34 | 90 |
| (12) | bone (58) | bone (<4) | 247 | 1.3 | 3.0 | 0.15 | 20 | 95 |

Comparing the use of low methionine fish gelatin to low methionine bone gelatin during grain growth, where nucleation in both instances employs high methionine bone gelatin, it is apparent that the presence of the low methionine fish gelatin during grain growth increases average grain ECD and aspect ratio and lowers average tabular grain thickness.

The invention has been described in detail with particular reference to preferred embodiments thereof, but it will be understood that variations and modifications can be effected within the spirit and scope of the invention.

What is claimed is:

1. A process of precipitating a photographically useful emulsion containing silver halide grains comprised of at least 50 mole percent chloride, based on silver, with tabular grains having {100} major faces accounting for greater than 50 percent of total grain projected area and having an average thickness of less than 0.3 micrometer, comprised of the steps of (1) in an aqueous dispersing medium containing a peptizer forming silver halide grain nuclei accounting for from 1 to 10 percent of total silver, having a face centered cubic crystal lattice, and containing crystal lattice dislocations that promote the growth of high chloride {100} tabular grains and (2) introducing into the aqueous dispersing medium silver ions and halide ions that are greater than 50 mole percent chloride ions, based on silver, to grow high chloride {100} tabular grains, wherein during at least one of steps (1) and (2) gelatino-peptizer is present in the dispersing medium that satisfies the formula:

$$(Pro+Hypro)\div(Ser+Thr)=<4.0$$

wherein Pro, Hypro, Ser and Thr represent the proline, hydroxyproline, serine, and threonine amino acid components, respectively, of the gelatino-peptizer.

2. A process according to claim 1 wherein the gelatino-peptizer satisfies the formula:

$$(Pro+Hypro)\div(Ser+Thr)=<3.5.$$

3. A process according to claim 2 wherein the gelatino-peptizer satisfies the formula:

$$(Pro+Hypro)\div(Ser+Thr)=<3.0.$$

4. A process according to claim 1 wherein gelatino-peptizer present during step (1) satisfies the formula.

5. A process according to claim 4 wherein gelatino-peptizer present during step (1) contains at least 40 μmol of methionine per gram.

6. A process according to claim 5 wherein gelatino-peptizer present during step (1) contains at least 100 μmol of methionine per gram.

7. A process according to claim 1 wherein gelatino-peptizer present during step (2) satisfies the formula.

8. A process according to claim 1 wherein gelatino-peptizer present during step (1) satisfies the formula:

$$(Pro+Hypro)\div(Ser+Thr)=<4.0 \text{ and}$$

gelatino-peptizer present during step (2) satisfies the formula:

$$(Pro+Hypro)\div(Ser+Thr)=\geqq 4.0.$$

9. A process according to claim 8 wherein gelatino-peptizer present during step (1) contains at least 40 μmol of methionine per gram.

10. A process according to claim 8 wherein gelatino-peptizer present during step (2) contains less than 4 μmol of methionine per gram.

11. A process according to claim 1 wherein the grains are grown to have an average equivalent circular diameter of at least 2.0 μm.

12. A process according to claim 11 wherein the grains are grown to have an average equivalent circular diameter of at least 3.0 μm.

* * * * *